United States Patent [19]

Leonard

[11] 4,210,274

[45] Jul. 1, 1980

[54] BOXES

[76] Inventor: Lionel Leonard, Drumelzier House, Donnington Rd., Bicker, near Boston, Lincolnshire, England

[21] Appl. No.: 1,228

[22] Filed: Jan. 5, 1979

[30] Foreign Application Priority Data

Jan. 6, 1978 [GB] United Kingdom ..... 553/78
May 23, 1978 [GB] United Kingdom ..... 21674/78

[51] Int. Cl.[2] ..... B65D 5/42; B65D 57/00
[52] U.S. Cl. ..... 229/49
[58] Field of Search ..... 229/49

[56] References Cited

U.S. PATENT DOCUMENTS

| | | | |
|---|---|---|---|
| 254,115 | 2/1882 | Comstock | 229/49 UX |
| 1,129,040 | 2/1915 | McClure | 229/49 UX |
| 2,961,139 | 11/1960 | Nobili | 229/49 X |
| 3,220,633 | 11/1965 | Swane | 229/49 |
| 3,223,309 | 12/1965 | Chiorri | 229/49 |
| 3,226,008 | 12/1965 | Chiorri | 229/49 |
| 3,270,943 | 9/1966 | Polenghi | 229/49 X |
| 4,078,716 | 3/1978 | Harley et al. | 229/49 |
| 4,120,449 | 10/1978 | Gray | 229/49 |

FOREIGN PATENT DOCUMENTS

| | | | |
|---|---|---|---|
| 161393 | 2/1955 | Australia | 229/49 |
| 35102 | 4/1886 | Fed. Rep. of Germany | 229/49 |
| 45148 | 4/1889 | Fed. Rep. of Germany | 229/49 |
| 333394 | 6/1903 | France | 229/49 |
| 1153845 | 6/1956 | France | 229/49 |
| 1436626 | 3/1966 | France | 229/49 |
| 704105 | 4/1966 | Italy | 229/49 |
| 109492 | 9/1964 | Netherlands | 229/49 |
| 10728 | of 1887 | United Kingdom | 229/49 |
| 499182 | 3/1976 | U.S.S.R. | 229/49 |

*Primary Examiner*—Davis T. Moorhead
*Attorney, Agent, or Firm*—Leydig, Voit, Osann, Mayer & Holt, Ltd.

[57] ABSTRACT

Boxes e.g. for fruit and vegetables are described which consist of a base and sidewalls folded up from the base. The ends of the sidewalls are held in position relative to one another and relative to the base of the box by means of a number of corner posts, e.g. four for a rectangular box. Each corner post is produced from an extruded section and can simply be slid on to the two adjacent ends of sidewalls when they are held substantially in the upright position. Means are provided to stop lateral movement of one corner post relative to the one below it when two such boxes are stacked vertically aligned. Such means may comprise shaping on the end of each corner post or intermediate stacking pegs which engage e.g. the top of one corner post and the bottom of the vertically adjacent next box.

6 Claims, 45 Drawing Figures

BOXES

This invention relates to boxes.

The term boxes is used herein to refer to containers having a base, a plurality of side walls and optionally a lid. It includes boxes where the dimensions of the side walls and base are similar and also boxes in which the height of the side walls is much reduced, which have the form of an open topped tray. The term furthermore includes boxlike articles forming parts of other articles such as drawers for furniture. The invention is particularly applicable to boxes for storing and/or transporting goods, most particularly for transporting agricultural produce.

A very wide variety of open topped boxes for transporting agricultural produce is known. Many different attempts have been made to produce stacking boxes for such use which will be economic to produce, robust in use and fulfil sundry other desiderata for such boxes. Illustrative of the wealth of proposals are the following patent specifications: French Specifications Nos. 1304633, 1344783, 1393529, 1394547, 1403771, 1408320, 1436626 and its Certificate of Addition Nos. 87827, 2018317, 2056888 and 2194611; Swiss Patent Specification No. 589542; German Offenlegungsschrifts Nos. 1611004 and 2039269; Dutch Patent Specification No. 109492 and Dutch Published Patent Application No. 6414084; United Kingdom Patent Specifications Nos. 989157 and 1247340 and U.S. Pat. Nos. Specifications 3,223,309 and 4,078,716.

It is clearly evident from these specifications that numerous attempts have been made to provide a satisfactory box starting with a base having sidewalls which may be folded up from the material of the base and having corner members which engage the sidewalls and either themselves or with the addition of other members enable stacking of two like boxes one on the other. Many of the proposals involve the manufacture of detailed plastics corner pieces which can only be made by injection moulding. This is a highly expensive process, particularly for short runs, in view of the high injection mould costs and even if a box made according to any of these prior proposals would have satisfactory strength, the cost of manufacturing the corner pieces would render its manufacture uneconomic.

According to the present invention there is provided a box having a base and sidewalls folded up from the base, the sidewalls being held at their ends to form the corners of the box by extruded section corner posts, each corner post including elongate channels open at both ends to enable the post to be slid axially on to the ends of adjacent sidewalls to hold the walls together at the corner of the box and in planes substantially perpendicular to the base, and including means enabling one box to be stacked on top of a like box with the two corner posts at each corner of the stack of two boxes so formed being vertically aligned and being positively prevented from moving laterally with respect to each other.

By making the corner post a simple extruded section, very considerable economies in cost may be achieved. Additionally, assembly of boxes according to the present invention is very straightforward and simple and can be done rapidly and easily where desired.

The channels in the corner post, usually two in number, are each adapted to receive and grip the end of a side wall. In order to facilitate the production of a firm joint between the sidewalls and corner post, the ends of each sidewall may be folded back to form a double thickness section which engages in the channel, the folded back portions being glued to the sidewall if desired. In such a case it is very helpful to chamfer the ends of the folded back portions so that they are self-aligning when the corner post is axially slid thereon. It is particularly desirable to locate the chamfered portions in adjacent wall ends at different distances from the base of the box in order that as the corner post is pushed axially on to the folded back wall ends, it comes to be properly aligned first with one of the sidewall ends and then with the other.

While it is preferred to fold back the ends of the walls which engage in the channels, it is possible to adopt other means for preventing the sidewalls moving out of the channel in a direction transverse to the axial direction of the corner post, these other methods being used instead of or in addition to the folding back noted above. One such method is to provide the end of each sidewall with a thickening and to provide the channel at its outer edge with a flange on one or both sides. Likewise the sidewall may be provided with one or more grooves and the channel may bear one or more corresponding projections for engagement in the groove. The grooves may be formed by the act of sliding the corner post on to the end of a sidewall or they may be formed separately.

Alternatively, the channel may be arranged such that in section transverse to the longitudinal axis of the corner post the channel is aligned at an angle of up to 180° relative to the direction of the sidewall.

Preferably the base and sidewalls of the container are integral and formed from a single blank of material by cutting and folding. Cutting may take place by stamping in customary fashion when the material of the base and sidewalls is, for example, cardboard or like material.

The corner posts may be simple lengths of extruded plastics section, each length being cut in a plane transverse to its axis. In order to fix one positively relative to an underlying one, it is necessary to provide an intermediate stacking peg between the two vertically aligned corner posts, the stacking peg being engageable with the top of the lower corner post and with the base of the upper box either with part of the corner post of the upper box or with some other part of the upper box. A particularly preferred system of this type is one wherein each stacking peg consists of a base member, a first projection extending to one side of the member and adapted to engage in the lower of the two corner posts and a second projection extending the opposite side of the member and adapted to engage part of the base of the upper box. Most preferably in such a case the projections on the stacking peg are axially offset and the base of the upper box has an aperture adjacent each corner into which the second projection fits.

The stacking pegs are conveniently made by injection moulding.

Alternatively, lateral movement between two vertically aligned posts in the stack of boxes may be positively prevented by arranging that one end of each corner post has a cut-away portion and the other end of each corner post has a complementary cut-away portion so that each post locates positively with respect to the post above. Such corner posts may be made very economically by extruding a short section and subsequently removing a portion from each end. Such a post-extrusion forming may also include deforming one or both ends of the corner post to facilitate its assembly on the ends of the sidewalls of the box, e.g. by tapering flanges or the like on the corner post. In like fashion to the staggered chamfers on adjacent end walls, if such taperings are undertaken, they are preferably undertaken for both wall end engaging channels but at different axial positions on the corner post so that one such shaping is effective before the other to align the sidewalls accurately as the corner post is assembled on to the side walls.

The major advantage of the boxes of the present invention is that they may be produced extremely economically because of the use of an extruded corner post. Such corner posts may be produced simply and easily in very great quantities and only one extrusion die is required for a number of different length corner posts for different depth boxes. The corner posts may be made of any convenient material such as a plastics material or metal. Extruded plastics corner posts are preferred for economy and saving in weight. They may be made very strong so that the high axially compressives load on the box at the bottom of a stack may be withstood.

The exact shape of the extruded section may vary very widely. Conveniently the extrusion contains no closed sections which tend to slow down the extrusion process. The parts of the extrusion which constitute the walls of the channels may be made relatively thin thus saving on plastics while maintaining a high compressive strength. Such walls may be of the same or different extent in a plane transverse to the axis of the stacking post and may have a width to thickness ratio of for example 15:1 to 60:1. The surface of the extruded section may be plain or relieved, e.g. by extruded grooving.

If separate stacking pegs are used to form a stack and lock each corner post into the base of the box above, these preferably have frustoconical projections to engage the corner post and box, the tapering serving to facilitate the alignment of the stacking peg relative to the corner post and the box base.

It is found that by suitable design of the corner posts and choice of materials it is possible to make boxes according to the present invention which while made substantially of intrinsically weak material such as cardboard can nonetheless be stacked at least several containers high when loaded with goods such as fruit or vegetables without fear of collapse of the lowermost container or containers in the stack followed by toppling of the stack.

Boxes of the present invention are of particular value in horticultural, agricultural and similar applications, including the packaging of flower bulbs, plants and flowers in addition to fruit and vegetables noted above. The boxes may also be used in many areas of industrial application where fragile or easily damaged articles or products are shipped in boxes or they may be used in offices, libraries, depositories and the like where it is desired to store large quantities of papers or other documents.

If desired, after assembly, the corner posts may be fixed relative to the box base and side walls e.g. by gluing, stapling or riveting.

The invention is illustrated by way of example with reference to the accompanying drawings in which.

Figure 2:
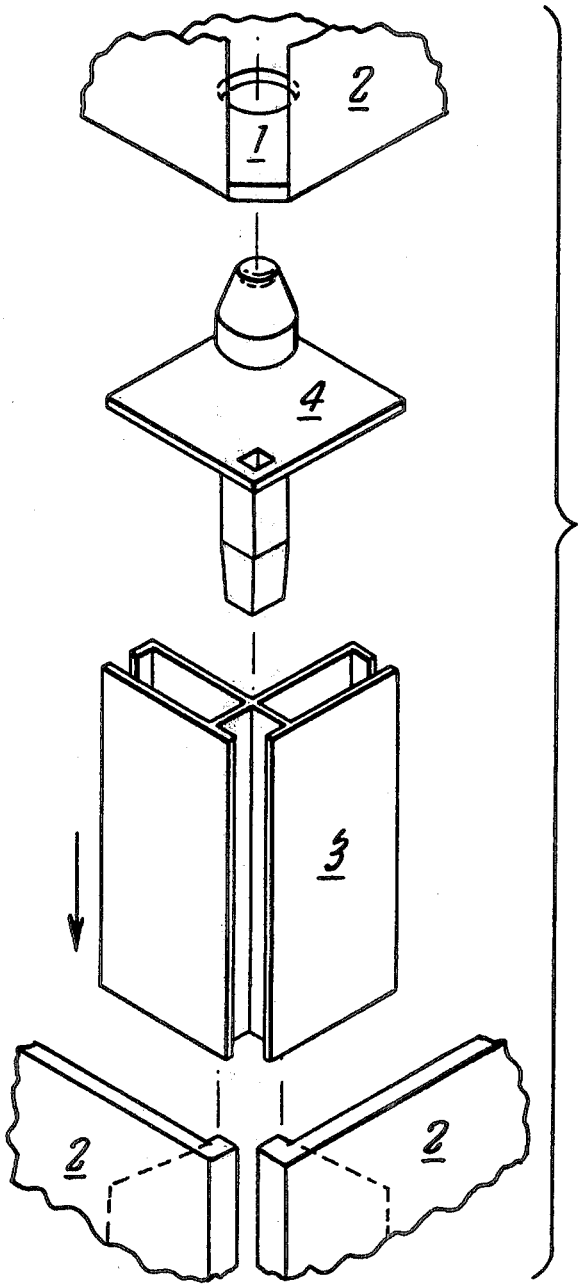
FIG. 2 is a perspective exploded view on an enlarged scale of a corner of a box showing the corner post and stacking peg in disassembled condition.

FIGS. 5 to 15 inclusive are sections similar to FIG. 2 showing alternative configurations;

FIGS. 16 to 21 are sections through alternative forms of corner post.

Figure 3:
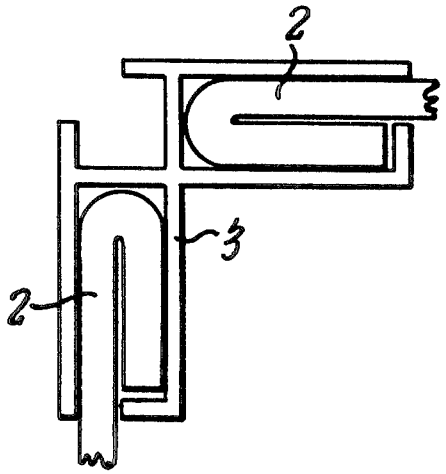
FIG. 3 is a horizontal section through the corner of a box as shown in FIG. 2 but in the assembled condition.
Figure 4:
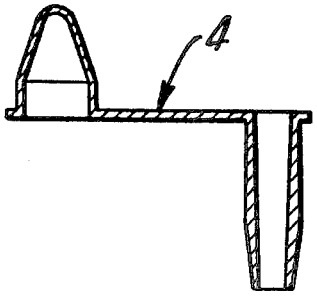
FIG. 4 is a vertical section through the stacking peg.
Figure 5:
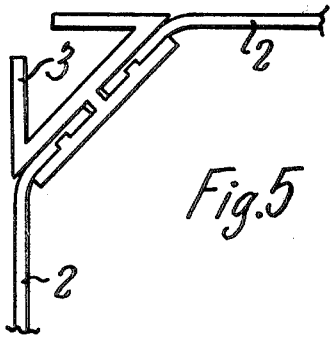
Figure 9:
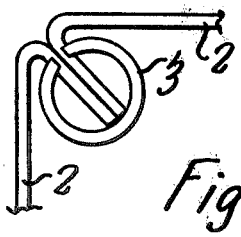
Figure 6:
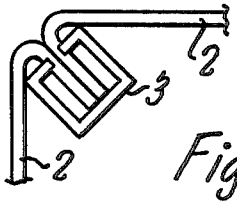
Figure 10:
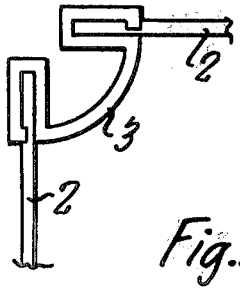
Figure 7:
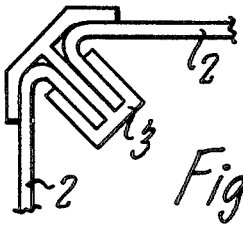
Figure 11:
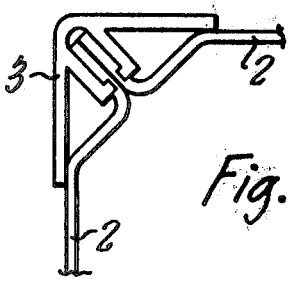
Figure 8:
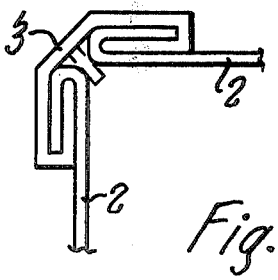
Figure 36:
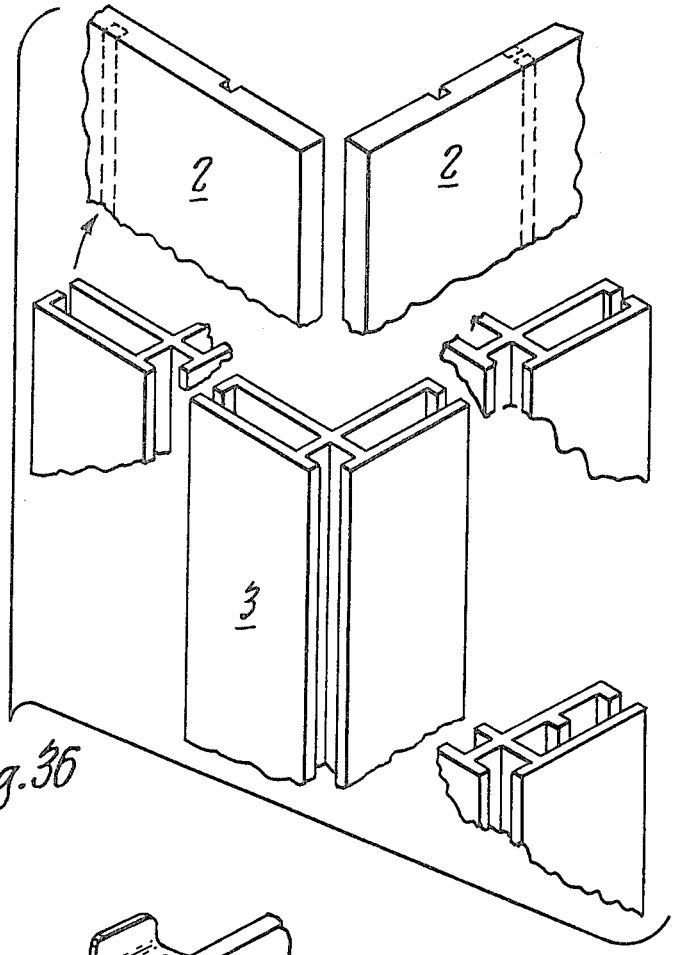
Figure 37:
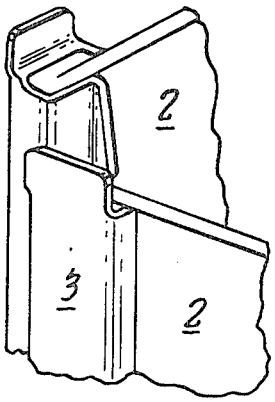
Figure 38:
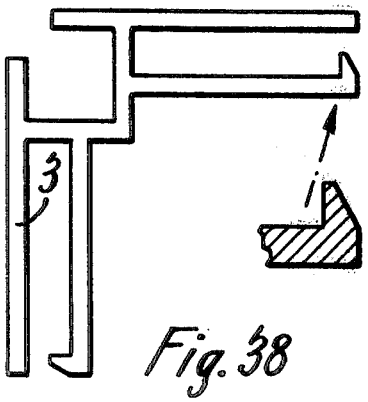
Figure 39:
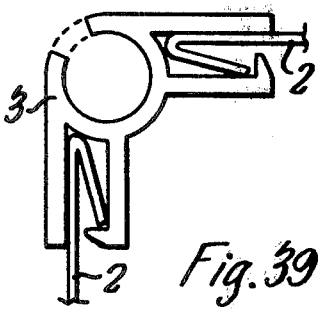
Figure 40:
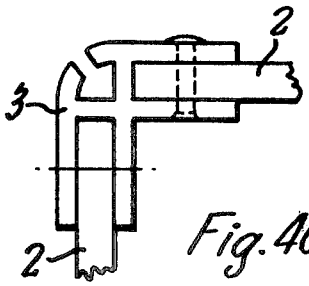
Figure 41:
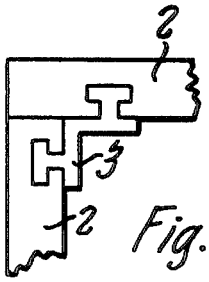

FIGS. 22 to 35 inclusive are horizontal sections through the sidewall ends showing alternative configurations for the sidewalls;

FIG. 36 is an exploded perspective view showing the corner post of FIGS. 2 and 3 and ends of the sidewalls with three alternative embodiments also shown;

FIG. 37 is a perspective view of the top of a metal corner post having flanges to assist stacking of the containers;

FIG. 38 shows an alternative form of corner post;

FIG. 39 shows a further alternative form of corner post and showing the range of card thicknesses which can be accomodated;

FIGS. 40 and 41 show further wall and corner post configurations, and

Figure 42:
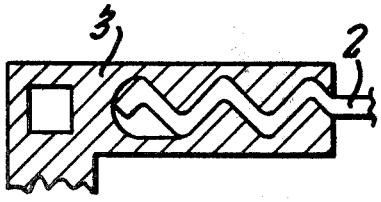
Figure 43:
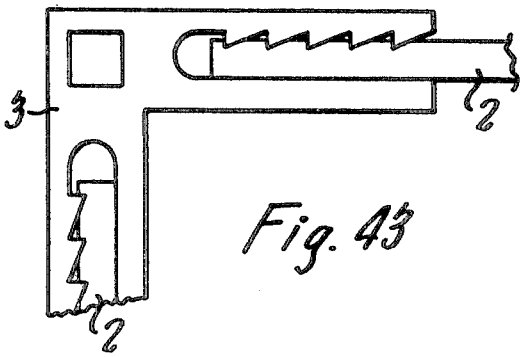
Figure 44:
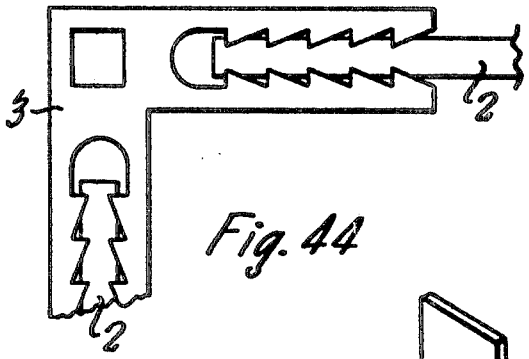

FIGS. 42 to 44 show further variants of the channel cross-section.

Figure 45:
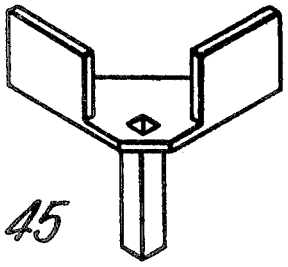

FIG. 45 is a perspective view of an alternative form of stacking peg.

Referring to the drawings it is observed that like parts are designated throughout by like reference numbers, as follows:

box base: 1
box sidewalls: 2
corner post: 3
stacking peg: 4

Figure 1:
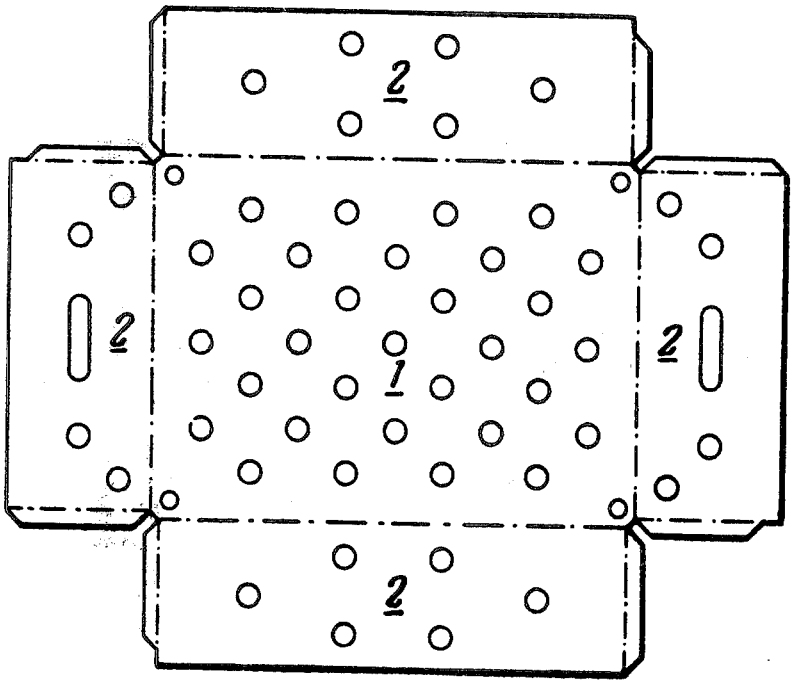
FIG. 1 is a plan view of a box blank.

FIG. 1 shows a box blank. The tabs at the ends of the sidewalls 2 are folded back through 180° and if desired glued in place to form a thickened endpiece for reception in a channel of a corner post 3 as shown in FIG. 2. The tabs are tapered at their ends to aid entry into the channels on the corner posts, and one tab is shorter than the other so further assisting alignment.

Figure 21:
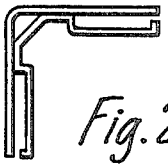
Figure 22:
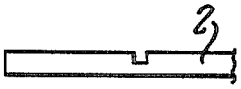
Figure 23:
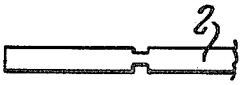
Figure 24:
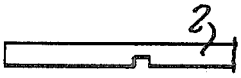
Figure 25:
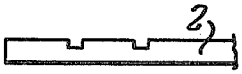
Figure 26:
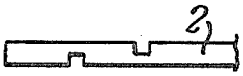
Figure 27:
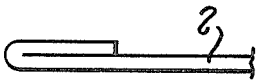
Figure 28:
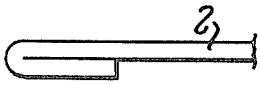
Figure 29:
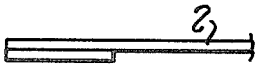
Figure 30:
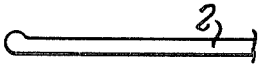
Figure 31:
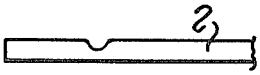
Figure 32:
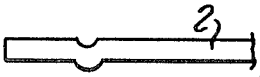
Figure 33:
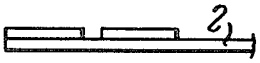
Figure 34:
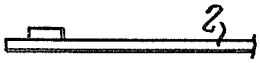
Figure 35:
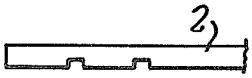

The type of corner post shown in FIGS. 2 and 3 can be used with box blanks of the thickness shown, with a folded sidewall end as shown in FIG. 3, or it can receive a grooved sidewall end as in FIG. 21, where the sidewalls are of double thickness material.

Figure 12:
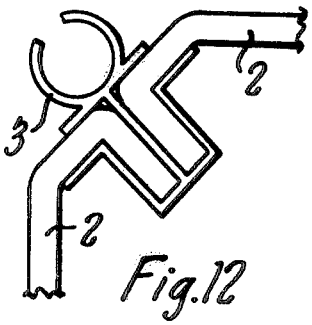
Figure 13:
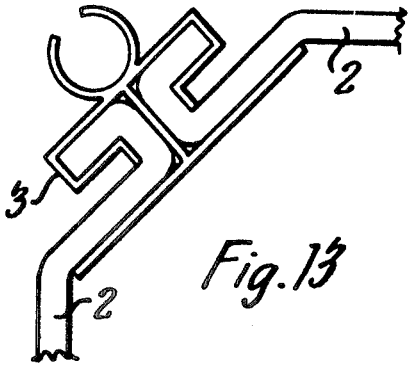
Figure 14:
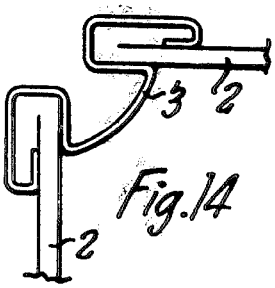
Figure 15:
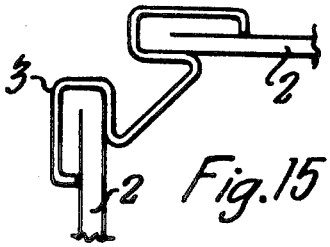
Figure 16:
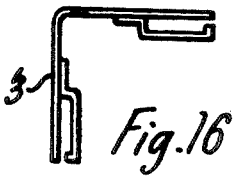
Figure 17:
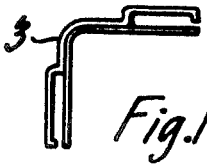

The corner post configuration shown in FIG. 12 is of particular value where the container walls 2 are made of thick twin-flute corrugated cardboard, since such material cannot easily be bent through more than 90°.

As shown in FIG. 41, the range of wall thicknesses that can be accommodated in the same corner post is very large. As shown, the wall 2 in FIG. 39 is about a quarter the thickness of the maximum wall size acceptable by that cornerpost (with a sidewall grooved as in FIG. 24). The tapering of the free end of the flange, as shown in FIGS. 40 and 41, and in the enlarged detail on FIG. 40, assists assembly of the cornerpost on the sidewalls.

The corner post shown in FIG. 41 is of particular value in the manufacture of boxes with thick walls e.g. of wood, fibreboard or particle board, either for heavy duty containers or e.g. for making drawers or furniture such as cabinet carcasses.

Most of the corner posts 3 can be made by extrusion and cutting. That of FIG. 37 may be made by extrusion, cutting and a simple thermoforming treatment.

Figure 18:
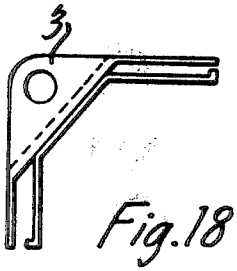
Figure 19:
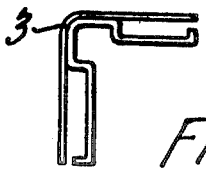
Figure 20:
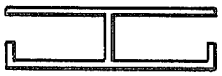

Post 3 shown in FIG. 18 is made by extrusion and subsequent forming and piercing.

The stacking peg 4 of FIG. 45 is designed for use with post 3 as in FIGS. 2 and 3. The stacking pegs 4 are all made by injection moulding.

I claim:

1. A box having a base and sidewalls folded up from the base, the sidewalls being held at their ends to form the corners of the box by extruded section corner posts, each corner post including a plurality of elongate channels open at both ends to enable the post to be slid axially on to the ends of adjacent sidewalls to hold the walls together at the corner of the box and in planes substantially perpendicular to the base, and including means comprising a plurality of stacking pegs each having a first and a second extremity enabling one box to be stacked on top of a like box with the two corner posts at each corner of the stack of two boxes so formed being vertically aligned, each said corner post at its top including means for engagement with a first extremity of a stacking peg, said base including adjacent a plurality of its corners means for engagement with a second extremity of a stacking peg, and each stacking peg having an offset configuration whereby each peg is engageable via the first extremity thereof with said engagement means at the top of a corner post and via the second extremity thereof with said engagement means in the base of a like box stacked immediately above, and the two boxes so stacked are positively prevented from moving laterally with respect to each other.

2. The box of claim 1 wherein the stacking pegs each consist of a flat base member, a first projection extending to one side of the base member and adapted to engage said engagement means in the corner post and a second projection extending to the opposite side of the base member and adapted to engage said engagement means of the base of a like box.

3. The box of claim 2 wherein the projections on the stacking peg are axially offset, and the base of the box has an aperture adjacent each corner into which the second projection fits.

4. The box of claim 1 wherein the ends of each sidewall are folded back to form a double thickness section which engages in the channel.

5. The box of claim 4 wherein the ends of the folded back portions are chamfered and are located at different distances from the base of the box.

6. The box of claim 4 wherein the folded back portion is glued to the sidewall.

* * * * *